US007489284B2

(12) United States Patent
Shih

(10) Patent No.: US 7,489,284 B2
(45) Date of Patent: Feb. 10, 2009

(54) ANTENNA CLIP AND ITS APPLICATIONS

(75) Inventor: Hsien-Kuang Shih, Chang Hwa (TW)

(73) Assignee: K.S. Terminals, Inc., Chang Hwa (TW)

( * ) Notice: Subject to any disclaimer, the term of this patent is extended or adjusted under 35 U.S.C. 154(b) by 113 days.

(21) Appl. No.: 11/797,031

(22) Filed: Apr. 30, 2007

(65) Prior Publication Data

US 2008/0198091 A1 Aug. 21, 2008

(30) Foreign Application Priority Data

Feb. 16, 2007 (TW) ..... 96203252 U

(51) Int. Cl.
*H01Q 1/12* (2006.01)

(52) U.S. Cl. ..... 343/878; 343/906

(58) Field of Classification Search ..... 343/878, 343/880, 906, 702; 439/698, 940, 83, 620
See application file for complete search history.

(56) References Cited

U.S. PATENT DOCUMENTS

| | | | | |
|---|---|---|---|---|
| 2,909,354 | A | 10/1959 | Bingham | |
| 5,353,199 | A | 10/1994 | Ohashi | |
| 5,374,205 | A | 12/1994 | Ohashi | |
| 5,391,098 | A | 2/1995 | Ohashi | |
| 5,539,417 | A | 7/1996 | Terry et al. | |
| 5,674,023 | A | 10/1997 | Williams | |
| 5,828,343 | A | 10/1998 | MacDonald, Jr. et al. | |
| 5,835,071 | A | 11/1998 | Phelps | |
| 6,083,030 | A | 7/2000 | Wright | |
| 6,149,470 | A * | 11/2000 | Northey et al. | 439/698 |
| 6,181,950 | B1 | 1/2001 | Mendolia | |
| 6,238,247 | B1 * | 5/2001 | Belopolsky et al. | 439/620.18 |
| 6,326,928 | B1 | 12/2001 | Kitamura et al. | |
| 6,942,500 | B2 | 9/2005 | Chen | |
| 6,991,472 | B2 | 1/2006 | Du et al. | |
| 7,085,139 | B2 | 8/2006 | Chen | |
| 7,128,610 | B1 | 10/2006 | Chiang | |
| 7,175,488 | B2 * | 2/2007 | Pavlovic et al. | 439/858 |
| 2007/0052100 | A1 * | 3/2007 | Bellinger | 257/758 |

* cited by examiner

*Primary Examiner*—Hoang V Nguyen
(74) *Attorney, Agent, or Firm*—Reed Smith LLP; Juan Carlos A. Marquez, Esq.

(57) ABSTRACT

The present invention discloses an antenna clip and an application thereof, wherein the antenna clip includes a base and a pair of spring elements. The base has a foundation with a first wall and a second wall connecting to two sides of the foundation. The first wall and the second wall are opposite to each other. The surface of the foundation facing the first and the second walls is formed with at least one protuberance. Wherein, the pair of spring elements are respectively extended toward a center from the first wall and the second wall so as to clamp the antenna clip together with the protuberance formed on the foundation.

16 Claims, 12 Drawing Sheets

ANTENNA CLIP AND ITS APPLICATIONS

FIELD OF THE INVENTION

The present invention relates to an antenna clip and the application thereof; and more particularly, the present invention relates to an antenna clip and the application thereof where the antenna clip can be securely affixed on a printed circuit board (PCB).

BACKGROUND OF THE INVENTION

Metal conductive terminal connectors in the conventional art are disclosed in U.S. Pat. No. 7,085,139, as shown in FIG. 1. In FIG. 1, an antenna clip connector 100 is provided on a printed circuit board (PCB) 102 so as to clamp the antenna clip. The antenna clip connector 100 is made of metal. It is formed as a U-shaped structure with a plurality of planes, having an opening for an antenna clip 104 to be contained within. The planes 106 is provided on the PCB 102 so as to support the whole antenna clip connector 100. The plane 106 is provided with a hole 108 to facilitate welding the plane 106 on the PCB 102. Additionally, a plurality of legs 110 are extended from the plane 106 such that the antenna clip connector 100 is more stably affixed on the PCB 102.

In the prior art, the antenna clip connector 100 is a U-shaped structure, so it is difficult to place the antenna clip 104 stably on the U-shaped structure. As a result, the antenna clip connector 100 and the antenna clip 104 are loosely connected. The support of the U-shaped structure is also very weak so that breaks may occur after continuous usage, causing a bad connection for the antenna clip connector. This is one place for improvement in the design of the connector.

SUMMARY OF THE INVENTION

In order to solve the problem faced in the conventional art, the present invention provides an antenna clip and the application thereof, wherein the antenna clip includes a base and a pair of spring elements. The base has a foundation with a first wall and a second wall connecting to two sides of the foundation. The first wall and the second wall are opposite to each other. A surface of the foundation facing the first and the second wall is formed with at least one protuberance. Wherein, the pair of spring elements are respectively extended toward a center from the first wall and the second wall so as to clamp the antenna clip together with the protuberance formed on the foundation.

Therefore, one object of the present invention is to provide a long-lasting antenna clip.

Another object of the present invention is to provide an antenna clip capable of stably reading data inside the antenna clip.

Yet another object of the present invention is to provide an antenna clip with a portable navigation device so as to last for a long time.

Yet another object of the present invention is to provide an antenna clip with a portable navigation device so as to stably read data inside the antenna clip.

Yet another object of the present invention is to provide a digital electronic device with an antenna clip so as to last for a long time.

Yet another object of the present invention is to provide a digital electronic device with an antenna clip so as to stably read data inside the antenna clip.

SUMMARY OF THE INVENTION

The present invention discloses an antenna clip and an application thereof, including a digital electronic device with the antenna clip. The digital electronic device is selected from a group consisting of photocopiers, portable computers, desktop computers, personal navigation devices (PND), digital media broadcasting devices (DMB), electronic gaming devices, electronic storage display media (such as electronic paper), mobile communication transmission devices, such as mobile phones, PDA, GPS, POS, POI, karaoke song selection systems, video phones and palm sized data processors, digital billboards, TV walls, ATM, stock exchange systems and scenery navigation systems. The basic principle of the antenna clip and the basic structure of the digital device are already understood by those skilled in the art and thus will not be further described hereinafter. Meanwhile, the drawings referenced are used for illustrating the characterized structure of the present invention and are not shown in actual scale.

Refer to FIG. 2A, which illustrates a schematic view of the first preferred embodiment of the present invention. As shown, antenna clip 1 of the present invention includes a base 10 and a pair of spring elements 11, wherein base 10 has a foundation 101 with a first wall 102 and a second wall 103 integrally connected to two sides of foundation 101. First wall 102 and second wall 103 are opposite to each other, and a surface of foundation 1011 facing first wall 102 and second wall 103 is formed with at least one protuberance 104. Additionally, the pair of spring elements 11 are respectively extended toward a center from first wall 102 and second wall 103 so as to clamp antenna clip 2 together with protuberance 104 formed on foundation 101 (Refer to FIG. 2B).

Refer to FIGS. 2B and 2C, which respectively shows frontal and side views of the antenna clip. In the embodiment, between spring elements 11 and first wall 102 and second wall 103 of antenna clip 1 is formed with a slot 105. Additionally, a contact point between first and second walls 102, 103 and spring elements 11 has a bend portion 111, and at least one notch 106 is formed on a side of bend portion 111 for first wall 102 and second wall 103. When spring elements 11 are forced, bend portion 111 is a pivot for distortion. Wherein, an end of spring elements 11 is each formed with contact portion 112 for clamping antenna clip 2. The contact portion 112 of the pair of spring elements 11 are reversely bent. A minimum range between the pair of contact portions 112, which is designated by the letter a; is smaller than a diameter A of antenna clip.

To further disclose antenna clip 1 of the above embodiment, base 10 can be made of conductive materials, preferably metal materials. At least one mounting portion 107 is formed on a side different from protuberance 104 on base 10. Mounting portion 107 is filled with metal welding material with low melting point. When protuberance 104 contacts antenna clip 2, electrical connection is formed.

Refer to FIG. 3A, which shows a schematic view of the second preferred embodiment of antenna clip in accordance with the present invention. As shown, antenna clip 1 of the present invention includes a base 10 and a plurality of spring elements 11. Base 10 has a foundation 101 with a first wall 102 and a second wall 103 integrally connected to two sides of foundation 101. First wall 102 and second wall 103 are opposite to each other. At least one protuberance 104 is formed on a surface 1011 of foundation 101 facing first and second walls 102, 103. Additionally, the plurality of spring elements 11 respectively extend toward a center from first wall 102 and second wall 103 so as to clamp antenna clip 2 together with protuberance 104 formed on foundation 101

(Refer to FIG. 3B), wherein the number of spring elements 11 extended from second wall 103 is different from that extended from first wall 102.

Refer to FIGS. 3B and 3C, which respectively show frontal and side views of the antenna clip. In the embodiment, a slot 105 is formed between spring elements 11, first wall 102 and second wall 103 of antenna clip 1. Additionally, a contact point between first and second walls 102, 103 and spring element 11 has a bend portion 111. At least one notch 106 is formed on a side of bend potion 111 for first wall 102 and second wall 103. An end of the pair of spring elements 11 is respectively formed with a contact portion 112 for clamping antenna clip 2. At least one mounting portion 107 is formed on a bottom of foundation 1012 on base 10 that is different from the side where protuberance 104 is formed. Wherein, the characteristics and connection relationship of protuberance 104, slot 105, notch 106, mounting portion 107, bend portion 111, contact portion 112 are the same as those of the first preferred embodiment and thus will not be repeated herein.

Refer to FIG. 4A, which shows a schematic view of antenna clip in the third embodiment in accordance with the present invention. As shown, antenna clip 1 of the present invention includes a foundation 101 with at least a first spring element 108 and a second spring element 109 integrally formed on two sides of foundation 101. First spring element 108 and second spring element 109 are opposite to each other. At least one protuberance 104 is formed on a surface 1011 of foundation 101 facing first and second spring elements 108, 109 such that first spring element 108, second spring element 109 and protuberance 104 formed on foundation 101 clamp antenna clip 2 together (Refer to FIG. 4B).

Refer to FIG. 4B, which shows a frontal view of an antenna clip. In the embodiment, an end of first and second spring elements 108, 109 of antenna clip 1 respectively forms a contact portion 112 for clamping antenna clip 2. At least one mounting portion 107 is formed on a bottom of foundation 1012 on base 10 that is different from the side where protuberance 104 is formed. Wherein, the characteristics and connection relationship of protuberance 104, mounting portion 107, contact portion 112 are the same as those of the first and second preferred embodiments and thus will not be repeated herein.

FIG. 5 illustrates applications of the above mentioned antenna clip on a variety of digital electronic devices. Any digital electronic device having the antenna clip, such as desktop computers, DMB, EED, electronic storage display media, such as electronic paper, electronic card or electronic notebook, mobile communication transmission device, GPS, POS, POI, karaoke song selection system, video phone and palm sized data processor, digital billboard, TV wall, ATM, stock exchange system and scenery navigation system, in which the relationship between the antenna clip of the present invention and the digital electronic device can be represented in the schematic view shown in FIG. 5.

Refer to FIG. 5, which shows the fourth preferred embodiment of the present invention. FIG. 5 takes an example of a wireless communication device to describe the configuration of the antenna clip of the present invention on the wireless communication device, such as a mobile phone. As shown, wireless communication device 4 has a shell 41, a motherboard, such as a printed circuit board 3 and an antenna clip 1 contained and affixed in shell 41. Antenna clip 1 includes a base 10 and a pair of spring elements 11, wherein base 10 has a foundation 101 with a first wall 102 and a second wall 103 integrally connected to two sides of foundation 101. First wall 102 and second wall 103 are opposite to each other, and a surface of foundation 1011 facing toward first wall 102 and second wall 103 is formed with at least one protuberance 104. Additionally, the pair of spring elements 11 are respectively extended toward a center from first wall 102 and second wall 103 so as to clamp antenna clip (not shown) together with protuberance 104 formed on foundation 101.

In this embodiment, a slot 105 is formed between spring elements 11 of antenna clip 1 and first wall 102 and second wall 103. Additionally, a contact point between first and second walls 102, 103 and spring element 11 has a bend portion 111, and at least one notch (not shown) is formed on a side of bend portion 111 on first wall 102 and second wall 103. Each end of the pair of spring elements 11 is formed with a contact portion 112 for clamping antenna clip 2. At least one mounting portion (not shown) is formed on a bottom of foundation 1012 on base 10 that is different from the side where protuberance 104 is formed.

Wherein, the characteristics and connection relationship of base 10, protuberance 104, mounting portion (not shown), bend portion (not shown), contact portion 112, antenna clip (not shown) are the same as those of the first preferred embodiment and thus will not be repeated herein.

Refer to FIG. 6, which shows the fifth preferred embodiment of the present invention. FIG. 6 takes an example of a wireless communication device to describe the configuration of the antenna clip of the present invention on the wireless communication device, such as a mobile phone. As shown, wireless communication device 4 has a shell 41, a motherboard, such as a printed circuit board 3 and an antenna clip 1 contained and affixed in shell 41. Antenna clip 1 includes a base 10 and a plurality of spring elements 11; wherein base 10 has a foundation 101 with a first wall 102 and a second wall 103 integrally connected to two sides of foundation 101. First wall 102 and second wall 103 are opposite to each other, and a surface of foundation 1011 facing toward first wall 102 and second wall 103 is formed with at least one protuberance 104. Additionally, the plurality of spring elements 11 are respectively extended toward a center from first wall 102 and second wall 103 so as to clamp antenna clip (not shown) together with protuberance 104 formed on foundation 101; wherein the number of spring elements 11 extended from second wall 103 is different from that extended from first wall 102.

In this embodiment, a slot 105 is formed between spring elements 11 of antenna clip 1 and first wall 102 and second wall 103. Additionally, a contact point between first and second walls 102, 103 and spring elements 11 has a bend portion 111, and at least one notch (not shown) is formed on a side of bend portion 111 on first wall 102 and second wall 103. Each end of the pair of spring elements 11 is formed with a contact portion 112 for clamping antenna clip 2. At least one mounting portion (not shown) is formed on a bottom of foundation 1012 on base 10 that is different from the side where protuberance 104 is formed.

Wherein, the characteristics and connection relationship of base 10, protuberance 104, mounting portion (not shown), bend portion (not shown), contact portion 112, antenna clip (not shown) are the same as those of the second preferred embodiment and thus will not be repeated herein.

Refer to FIG. 7, which shows the sixth preferred embodiment of the present invention. FIG. 7 takes an example of a wireless communication device to describe the configuration of the antenna clip of the present invention on the wireless communication device, such as a mobile phone. As shown, wireless communication device 4 has a shell 41, a motherboard, such as a printed circuit board 3 and an antenna clip 1 contained and affixed in shell 41. Antenna clip 1 includes a base 10 and is integrally connected to at least one first spring element 108 and second spring element 109 on two sides of foundation 101. First spring element 108 and second spring element 109 are opposite to each other, and a surface of foundation 1011 facing toward first and second spring elements 108, 109 is formed with at least one protuberance 104 so that first spring element 108, second spring element 109 and protuberance 104 formed on foundation 101 together clamp antenna clip (not shown).

In this embodiment, each end of first and second spring elements of antenna clip 1 is respectively formed with a contact portion 112 to clamp antenna clip 2. At least one mounting portion (not shown) is formed on a bottom of foundation 1012 on base 10 that is different from the side where protuberance 104 is formed. Wherein, the characteristics and connection relationship of protuberance 104, mounting portion (not shown), contact portion 112 are the same as those of the first and second preferred embodiments and thus will not be repeated herein.

The aforementioned embodiments are the preferred embodiments of the present invention and are not meant to limit the scope of the present invention. It should be understood by those skilled in the art that any modifications or changes of the embodiments do not depart from the spirit of the present invention and are included in the scope of the present invention.

Figure 1:
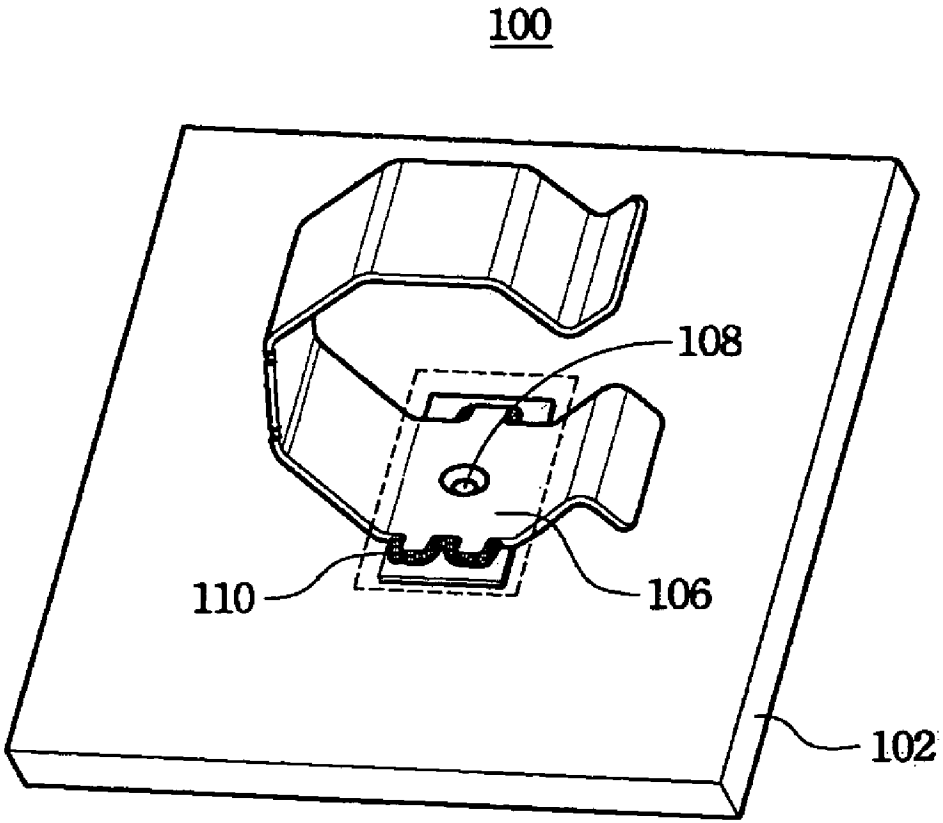
Fig. 1 (Prior Art)
FIG. 1 is a schematic view of an antenna clip of the present invention.
Figure 2B:
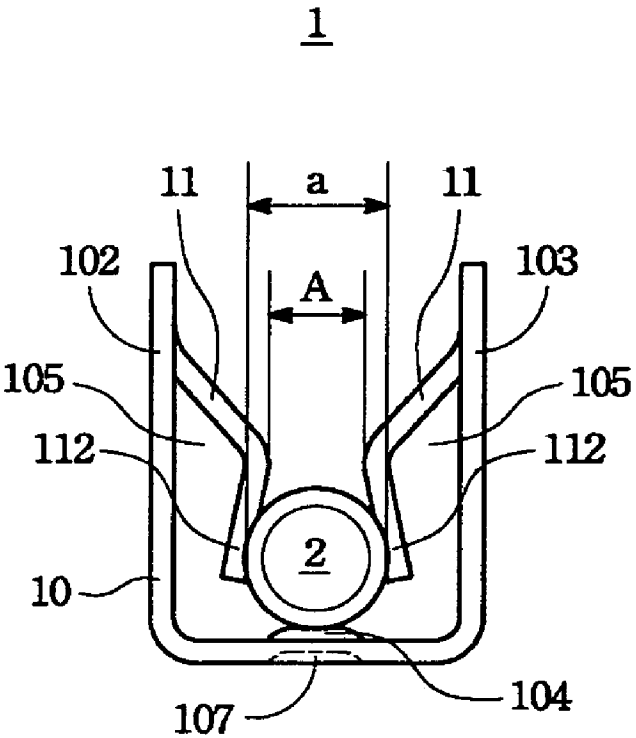
FIG. 2B is a frontal view of an antenna clip of the present invention.
Figure 2A:
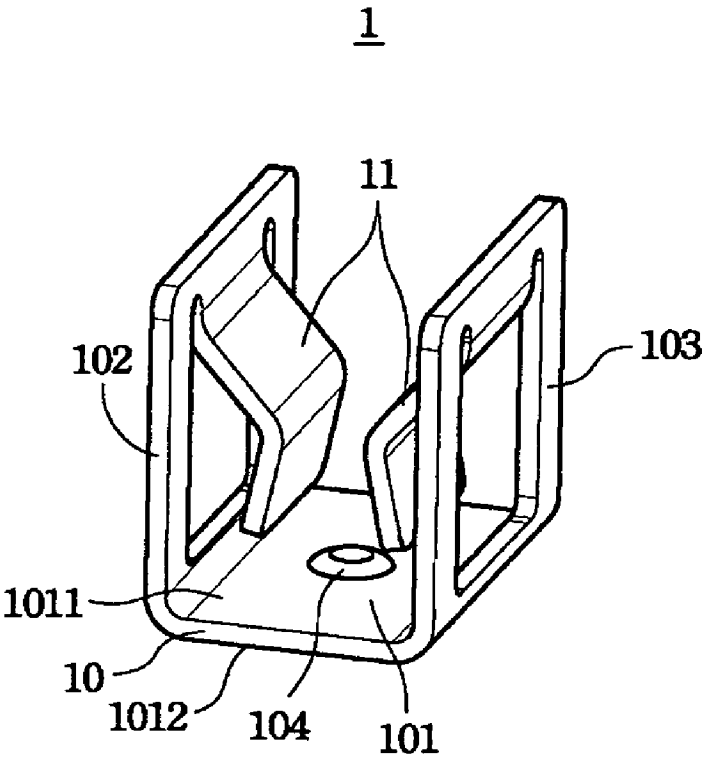
FIG. 2A is a schematic view of an antenna clip of the present invention.
Figure 2C:
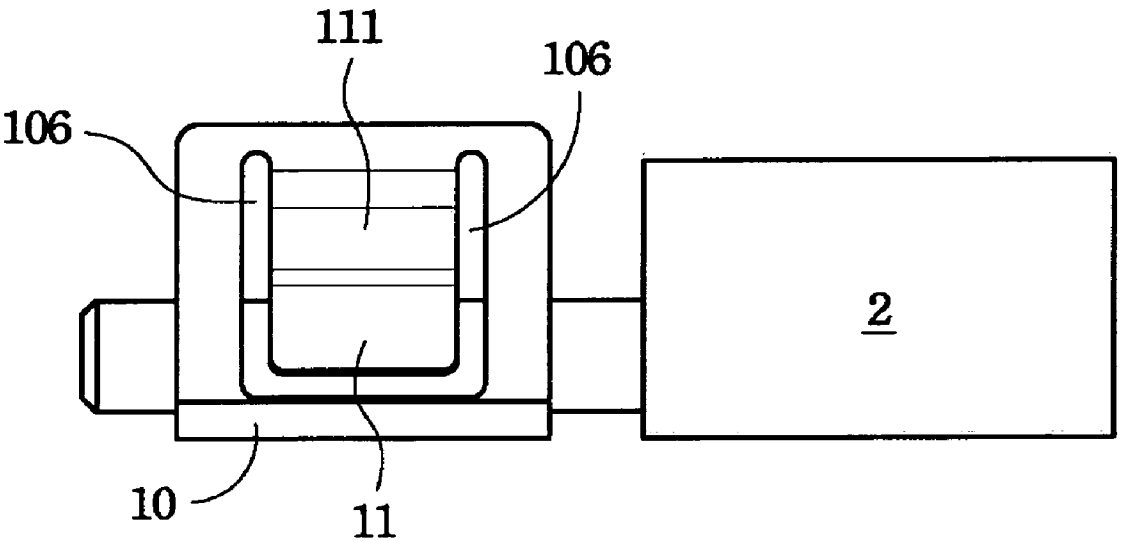
FIG. 2C is a schematic view of an antenna clip of the present invention.
Figure 3B:
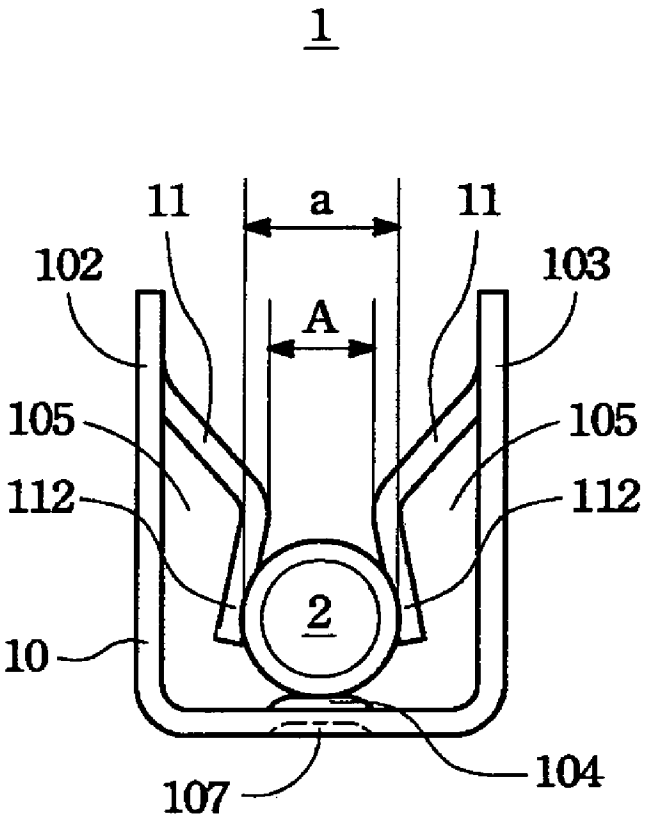
FIG. 3B is a frontal view of an antenna clip of the present invention.
Figure 3A:
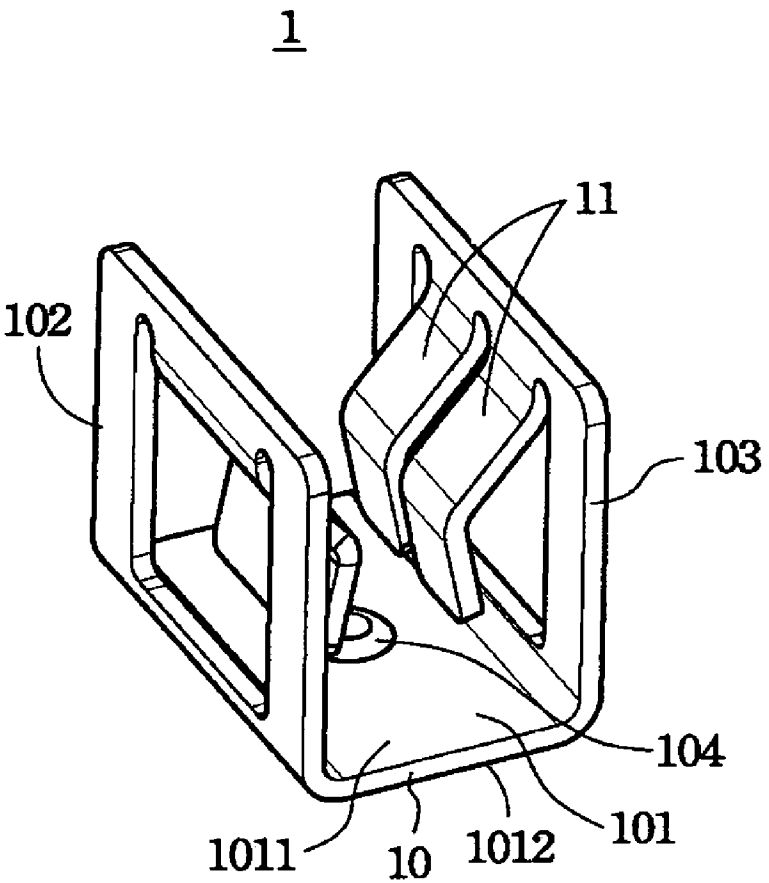
FIG. 3A is a schematic view of an antenna clip of the present invention.
Figure 3C:
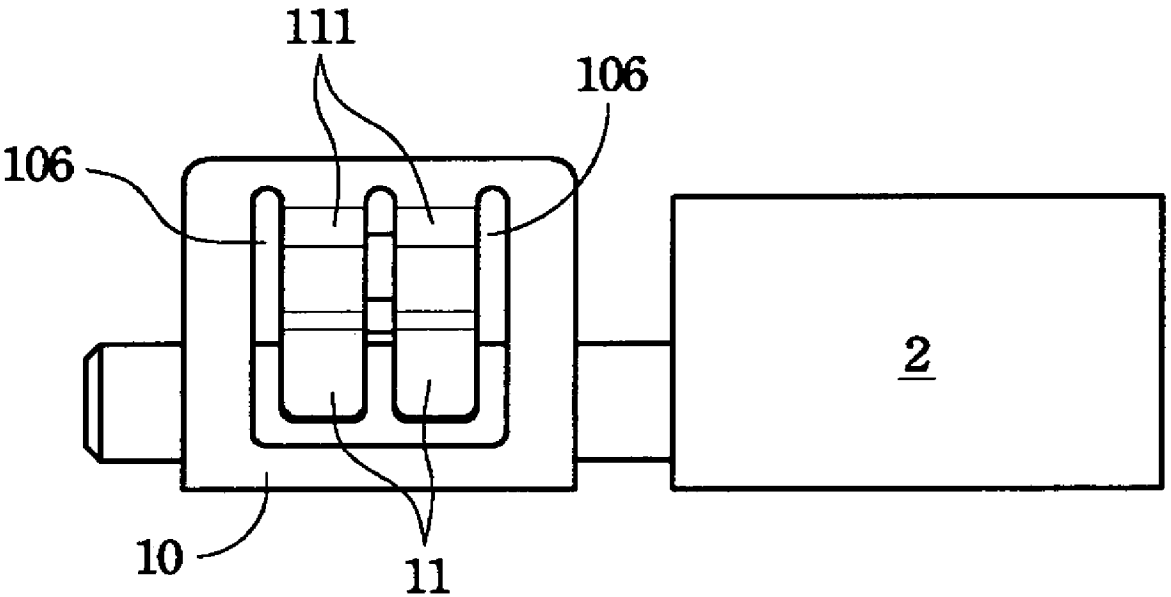
FIG. 3C is a schematic view of an antenna clip of the present invention.
Figure 4B:
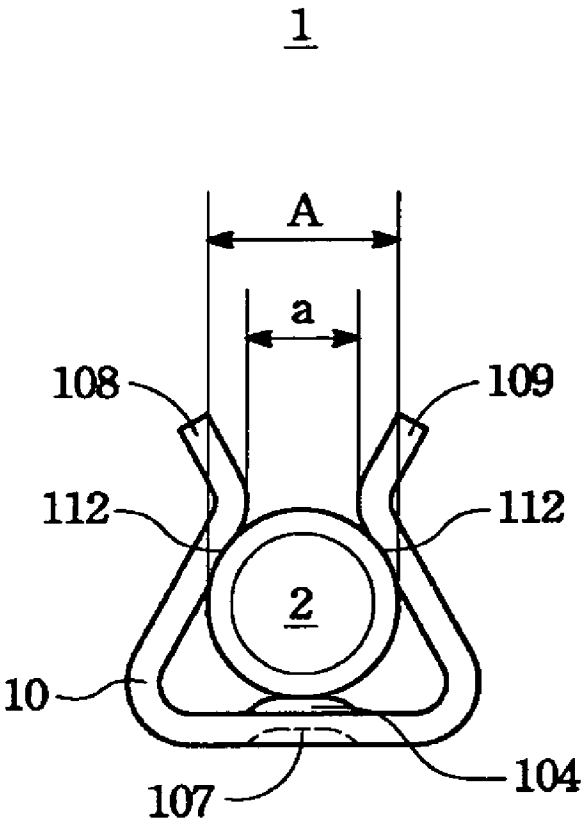
FIG. 4B is a frontal view of an antenna clip of the present invention.
Figure 4A:
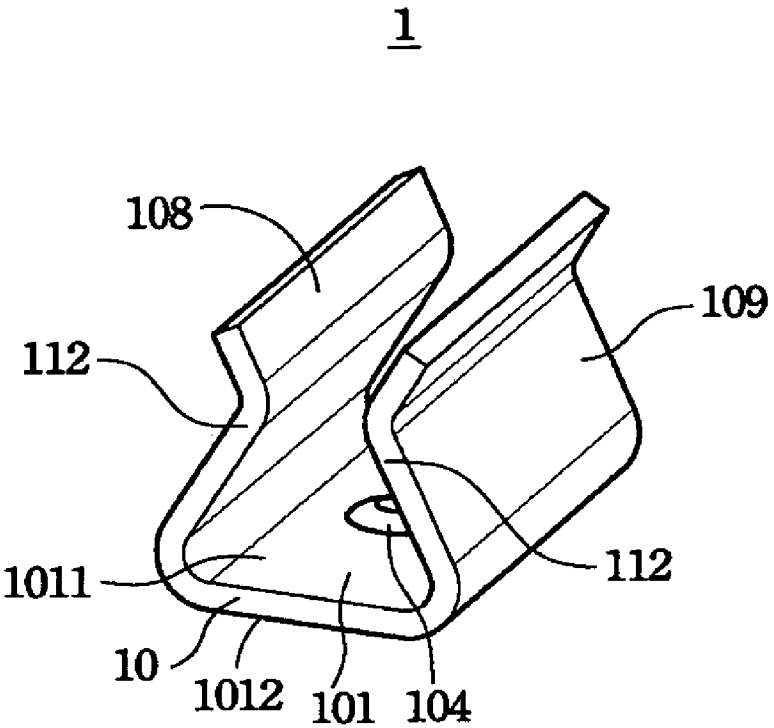
FIG. 4A is a schematic view of an antenna clip of the present invention.
Figure 5:
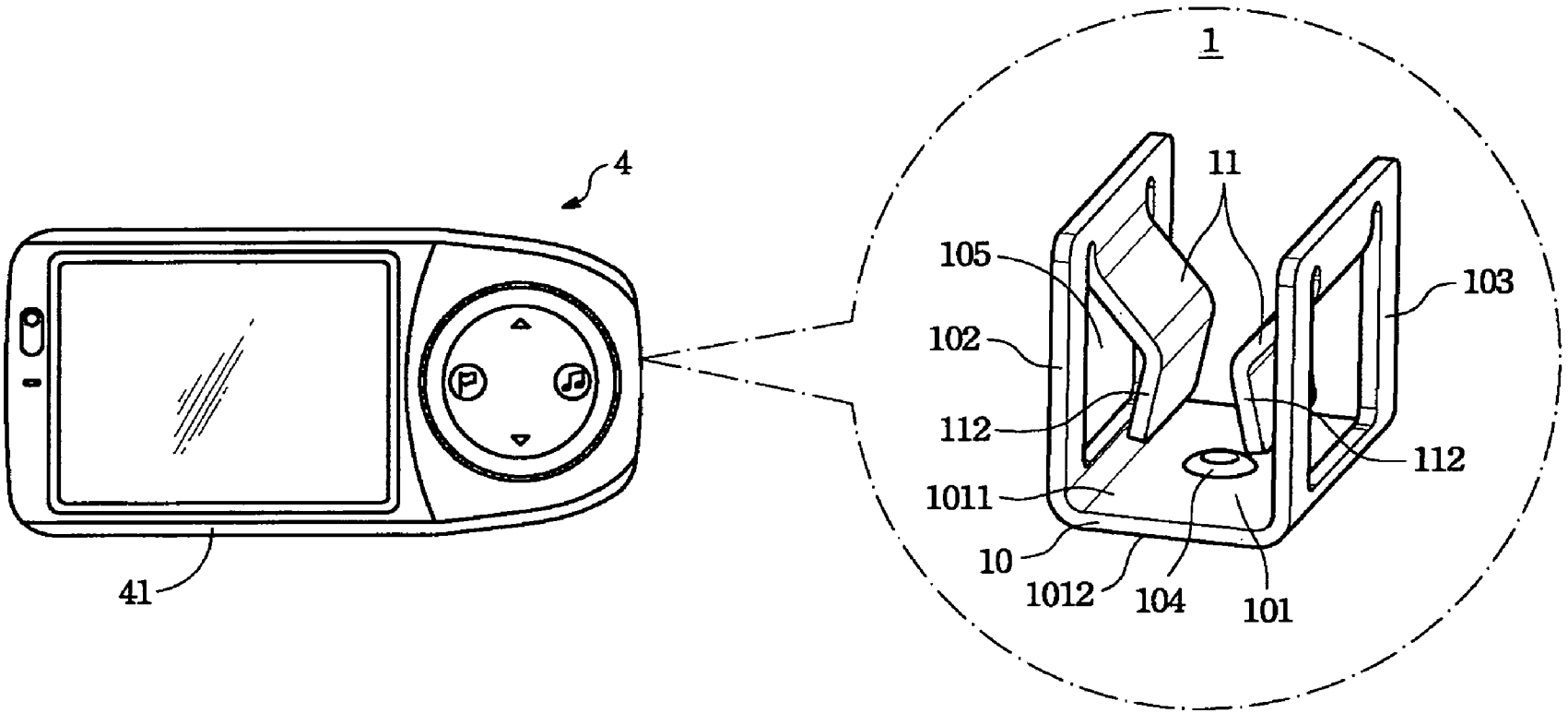
FIG. 5 shows a configuration of an antenna clip of the present invention on a wireless communication device.
Figure 6:
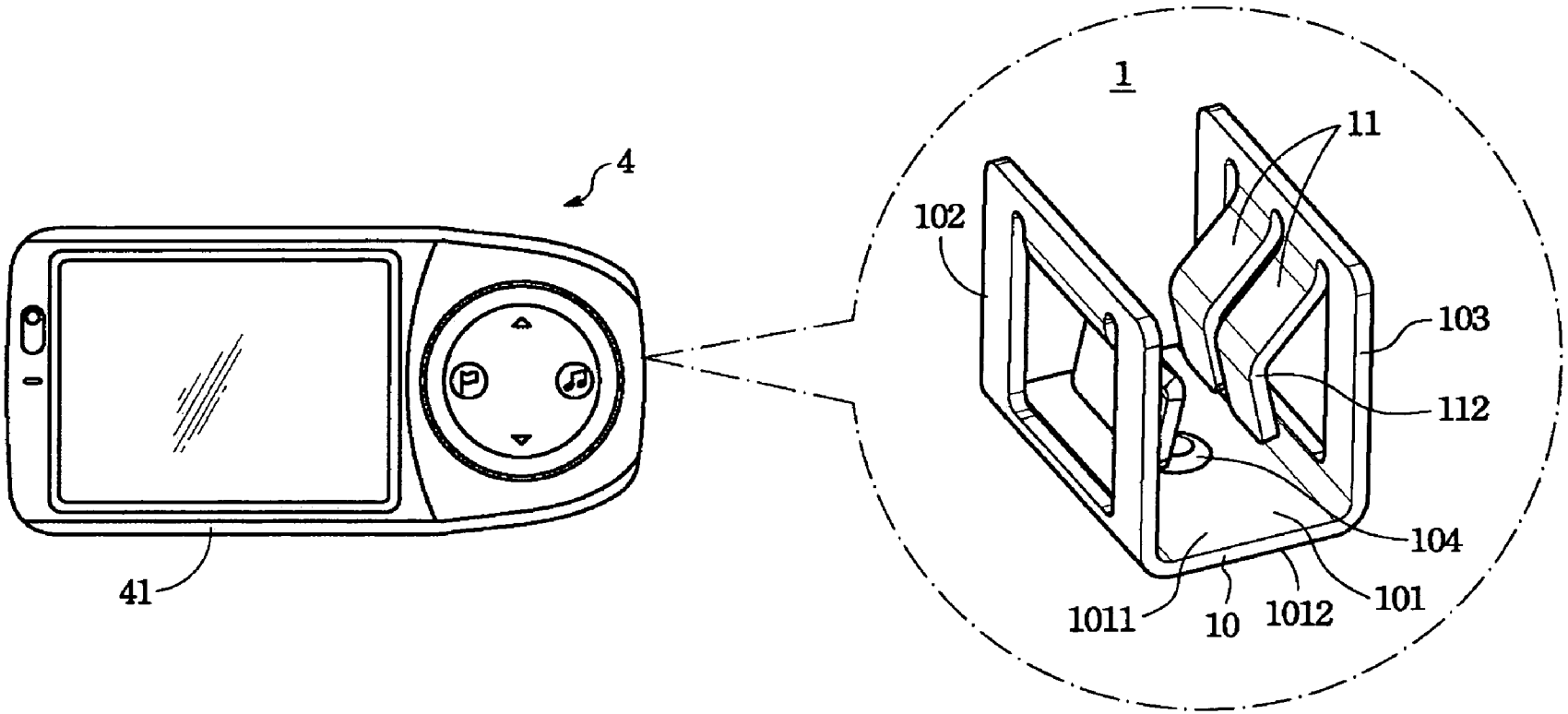
FIG. 6 shows a configuration of an antenna clip of the present invention on a wireless communication device.
Figure 7:
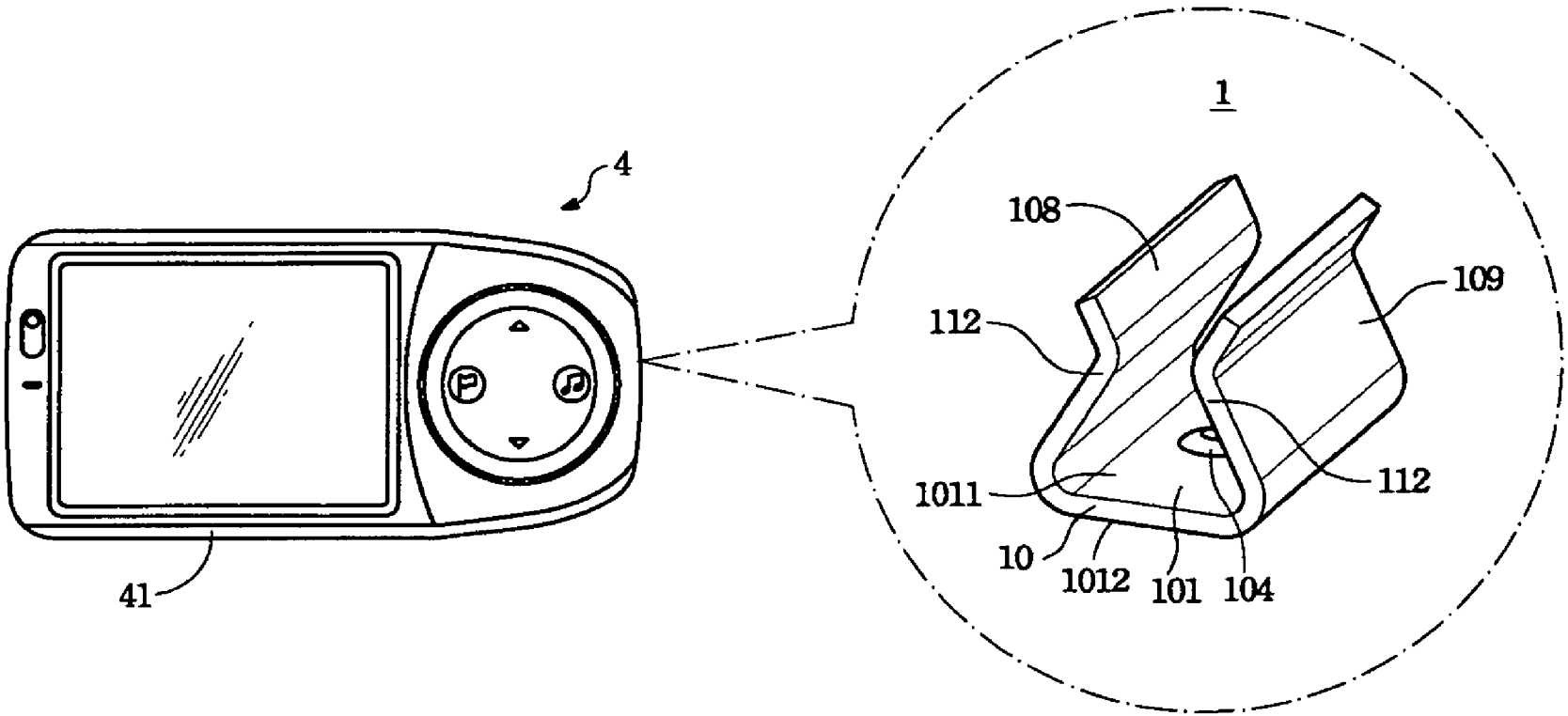
FIG. 7 shows a configuration of an antenna clip of the present invention on a wireless communication device.
Figure 8:
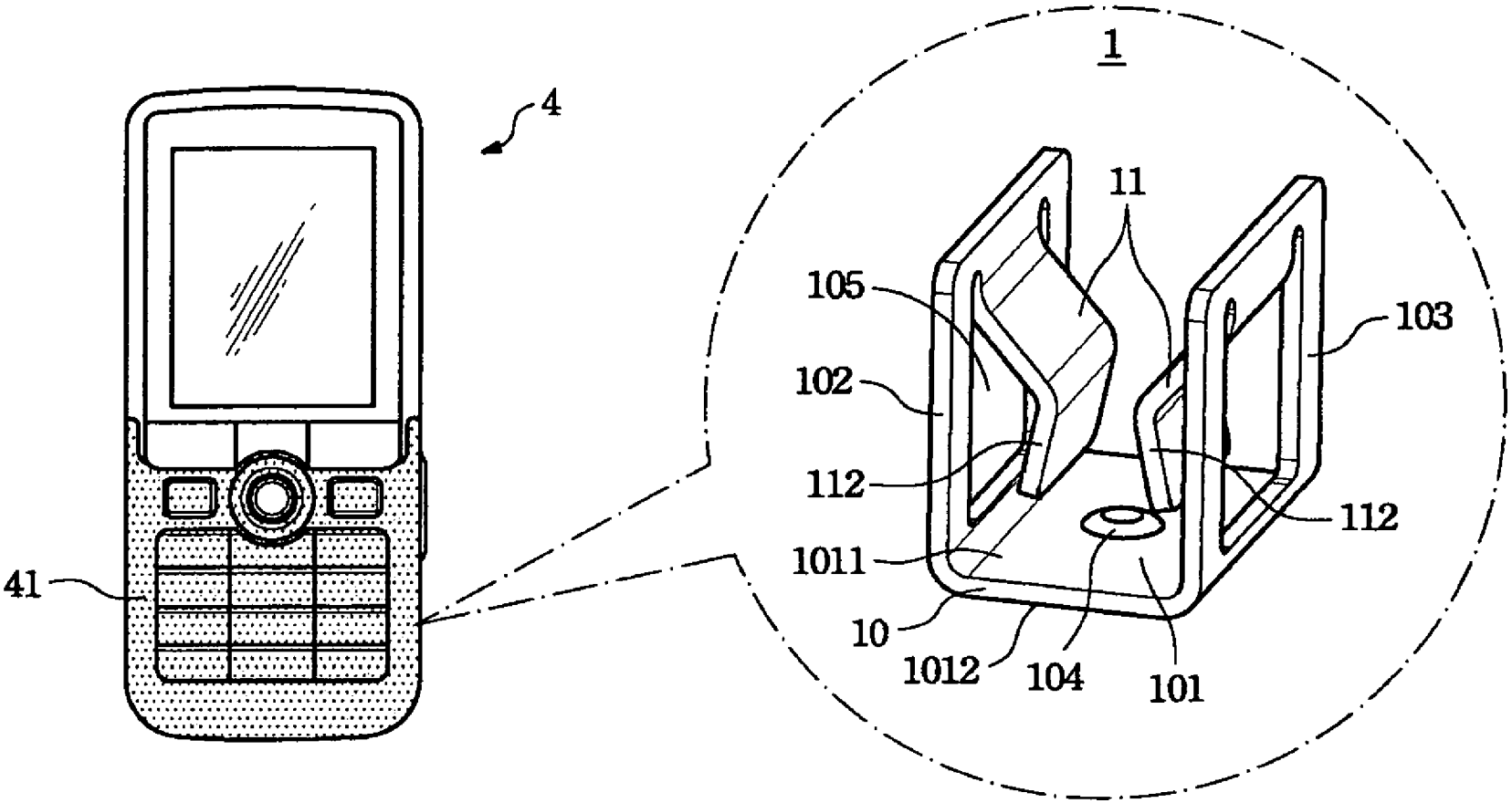
FIG. 8 shows a configuration of an antenna clip of the present invention on a wireless communication device.
Figure 9:
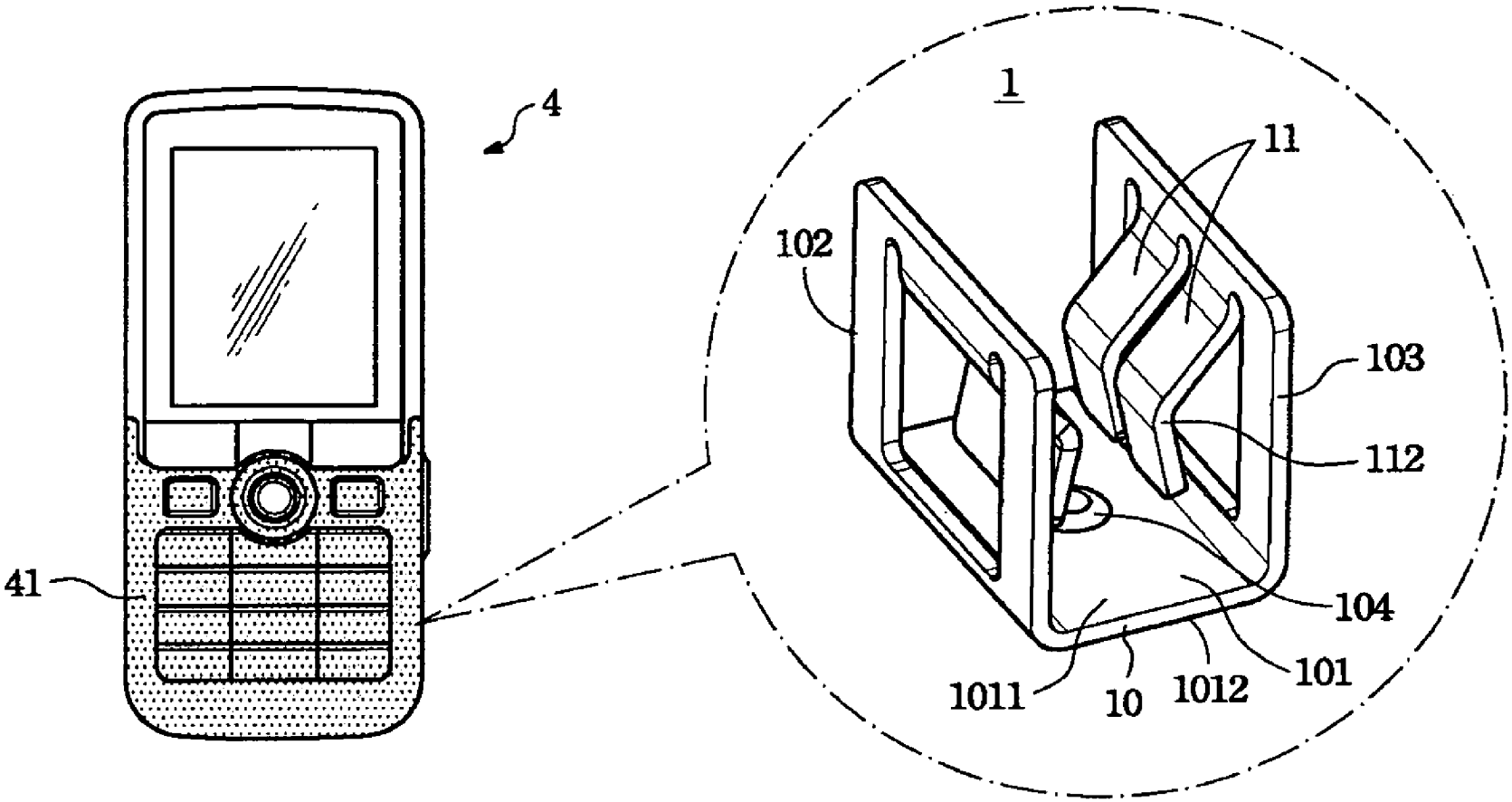
FIG. 9 shows a configuration of an antenna clip of the present invention on a wireless communication device.
Figure 10:
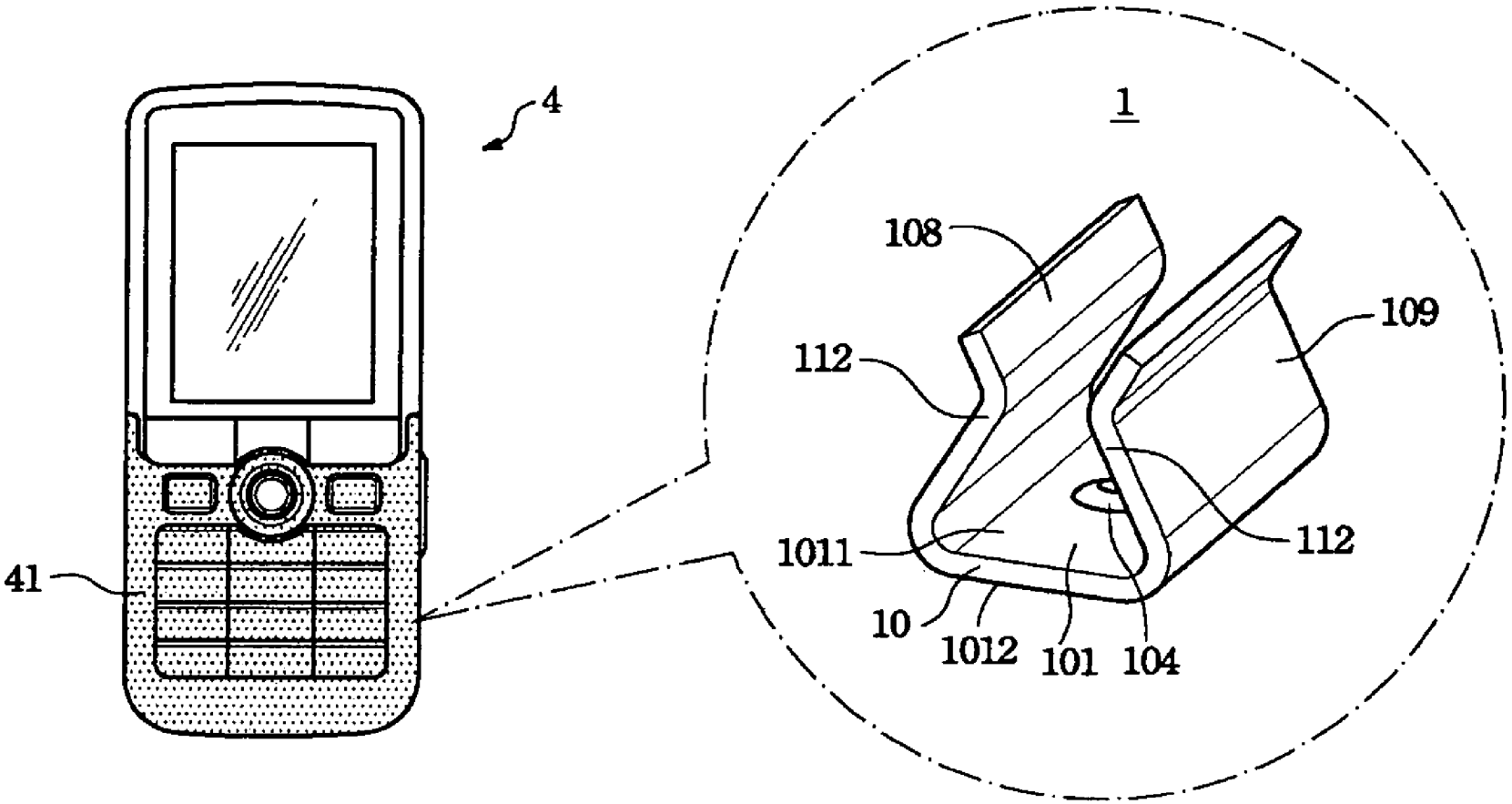
FIG. 10 shows a configuration of an antenna clip of the present invention on a wireless communication device.

What is claimed is:

1. An antenna clip, comprising:

a base having a foundation with a first wall and a second wall integrally connected to two sides of said foundation, said first wall and said second wall being opposite to each other, and a surface of said foundation facing towards said first and said second walls forming at least one protuberance; and a pair of spring elements, said spring elements respectively extended toward a center from said first wall and said second wall so as to clamp said antenna clip together with said protuberance formed on said foundation.

2. The antenna clip of claim 1, wherein a slot is formed between said spring elements and said first wall and said second wall.

3. The antenna clip of claim 1, wherein a contact point between said spring elements and said first and said second walls has a bend portion.

4. The antenna clip of claim 3, wherein at least one notch is formed between a side of said bend portion of said first wall and second wall.

5. The antenna clip of claim 1, wherein an end of said pair of spring elements is respectively formed with a contact portion for clamping said antenna clip.

6. The antenna clip of claim 5, wherein said contact portion of said pair of spring elements is reversely bent.

7. The antenna clip of claim 5, wherein a minimum range between said contact portion of said pair of spring elements is less than a diameter of said antenna clip.

8. The antenna clip of claim 1, wherein said base is made of a conductive material.

9. The antenna clip of claim 8, wherein said conductive material is a metal material.

10. The antenna clip of claim 1, wherein at least one mounting portion is formed on a bottom of said foundation on said base that is different from a side of said protuberance.

11. The antenna clip of claim 10, wherein said mounting portion is filled with a metal welding material with a low melting point.

12. An antenna clip, comprising:

a base having a foundation with a first wall and a second wall integrally connected to two sides of said foundation, said first wall and said second wall being opposite to each other, and at least one protuberance formed on a surface of said foundation facing said first and second walls;

a plurality of spring elements, said spring elements respectively extended toward a center from said first wall and said second wall so as to clamp said antenna clip together with said protuberance formed on said foundation, wherein a number of said spring elements extended from said second wall is different from a number of said spring elements extended from said first wall.

13. An antenna clip, comprising a foundation with at least a first spring element and a second spring element integrally connected on two sides of said foundation, said first spring element and said second spring element being opposite to each other, and at least one protuberance formed on a surface of said foundation facing said first and second spring elements so that said first spring element, said second spring element clamp said antenna clip together with said protuberance formed on said foundation.

14. A digital electronic device having an antenna clip, said digital electronic device selected from a group consisting of a mobile communication transmission device, a photocopier, a fax machine, a scanner, a multi-purpose machine, a wireless communication device, a GPS, an ATM, a POS and a POI, said antenna clip comprising:

a base having a foundation with a first wall and a second wall integrally connected to two sides of said foundation, said first wall and said second wall being opposite to each other, and at least one protuberance formed on a surface of said foundation facing said first and second walls; and a pair of spring elements, said spring elements respectively extended toward a center from said first wall and said second wall so as to clamp said antenna clip together with said protuberance formed on said foundation.

15. A digital electronic device having an antenna clip, said digital electronic device selected from a group consisting of a mobile communication transmission device, a photocopier, a fax machine, a scanner, a multi-purpose machine, a wireless communication device, a GPS, an ATM, a POS and a POI, said antenna clip comprising:

a base having a foundation with a first wall and a second wall integrally connected to two sides of said foundation, said first wall and said second wall being opposite to each other, and at least one protuberance formed on a surface of said foundation facing said first and second walls;

a plurality of spring elements, said spring elements respectively extended toward a center from said first wall and second wall so as to clamp said antenna clip together with said protuberance formed on said foundation, wherein a number of said spring elements extended from said second wall is different from a number of spring elements extended from said first wall.

16. A digital electronic device having an antenna clip, said digital electronic device selected from a group consisting of a mobile communication transmission device, a photocopier, a fax machine, a scanner, a multi-purpose machine, a wireless communication device, a GPS, an ATM, a POS and a POI, said antenna clip comprising:

a foundation with at least a first spring element and a second spring element integrally connected to two sides of said foundation, said first spring element and said second spring element being opposite to each other, and at least one protuberance formed on a surface of said foundation facing said first and said second spring elements so that said first spring element, said second spring element and said protuberance formed on said foundation together clamp said antenna clip.

* * * * *